United States Patent [19]

Marley

[11] 4,138,985

[45] Feb. 13, 1979

[54] PORTABLE HEATING AND COOKING STOVE

[76] Inventor: William R. Marley, 147 Filmore, Pocatello, Id. 83201

[21] Appl. No.: 823,464

[22] Filed: Aug. 10, 1977

[51] Int. Cl.[2] ..... F24C 1/14; F24B 3/00

[52] U.S. Cl. ..... 126/6; 126/66; 126/67

[58] Field of Search ..... 126/4, 6, 61, 66, 67, 126/98, 301

[56] References Cited

U.S. PATENT DOCUMENTS

| | | | |
|---|---|---|---|
| 310,623 | 1/1885 | Turner et al. | 126/6 |
| 446,413 | 2/1891 | Baker | 126/6 UX |
| 803,183 | 10/1965 | Menke | 126/4 |
| 1,334,827 | 3/1920 | Yost | 126/6 |
| 1,504,305 | 8/1924 | Alig | 126/4 |
| 2,220,414 | 11/1940 | Kritzer | 126/6 |
| 2,469,898 | 5/1949 | Schoch | 126/67 |

*Primary Examiner*—Carlton R. Croyle
*Assistant Examiner*—Richard E. Gluck
*Attorney, Agent, or Firm*—Clarence A. O'Brien; Harvey B. Jacobson

[57] ABSTRACT

A fire box is provided having upstanding peripheral walls and bottom and top walls. The fire box includes draft air inlet structure opening through the bottom wall thereof and flue gas outlet structure opening upwardly through the top wall thereof. The lower portion of the fire box includes horizontally outwardly projecting seat structure extending peripherally about at least all but one peripheral wall portion of the fire box and a downwardly opening hollow plenum box including upstanding peripheral walls and a top wall is also provided with the plenum box being removably downwardly telescoped over the fire box and with the lower portions of the peripheral walls of the fire box seated against and in at least reasonably good air sealed engagement with the seat structure and with the corresponding peripheral walls and top walls of the fire box and plenum box disposed in spaced relation defining a heating chamber therebetween. The top wall of the plenum box includes an opening therethrough into which the flue gas outlet structure opens and the aforementioned one peripheral wall portion of the fire box includes a horizontally outwardly projecting hollow neck opening through a lower portion thereof defining a fuel inlet passage. The peripheral wall of the plenum box corresponding to the aforementioned one peripheral wall portion of the fire box includes a downward opening notch in which the hollow neck is snugly received in reasonably good sealed engagement therewith. A lower peripheral wall of the plenum box includes an intake for admitting air to be heated into a lower portion of the heating chamber and the top wall of the plenum box includes a heated air outlet for discharging heating air from the upper portion of the heating chamber. The plenum may be upwardly removed from the fire box in order to enable the upper surface of the top wall of the fire box to be used as a cooking surface.

12 Claims, 9 Drawing Figures

132
28
20
92
98
94
96
102
80
76
72
35
40
38
44
36
42
22
93
116
24
66
64
34
54
52
112
130
26
18
90

126
124
10
84
88
16
164
12
98
96
94
106
108
104
78
74
48
38
62
58
68
64
66
50
60
144
56
42
52
4
114
24
14
30
100
93
116
112
86
156
34
32
46
35

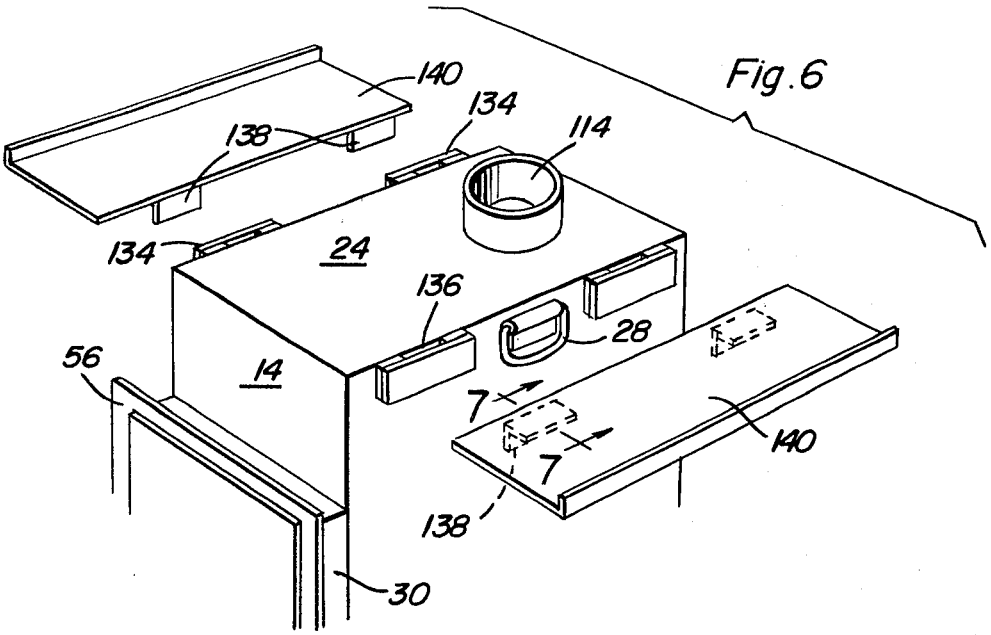
Fig. 6
Fig. 7
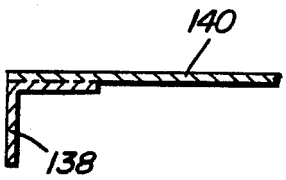
Fig. 8
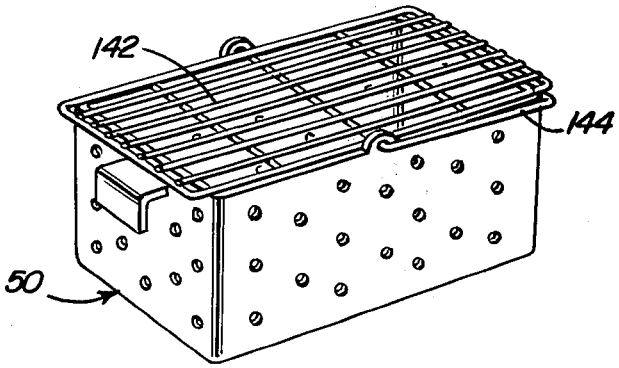
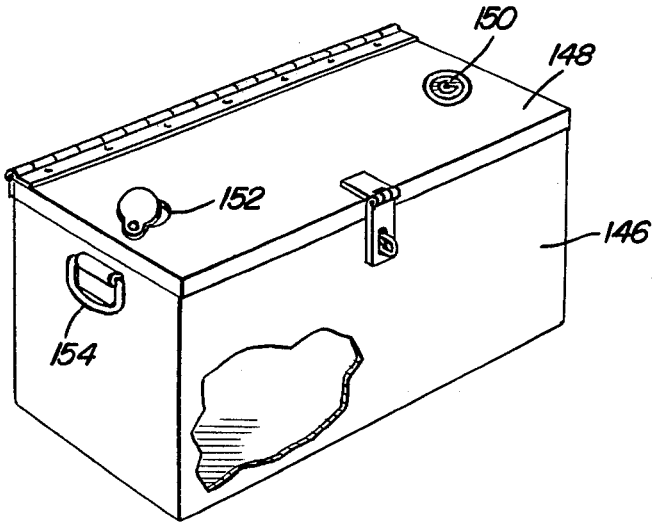
Fig. 9

PORTABLE HEATING AND COOKING STOVE

BACKGROUND OF THE INVENTION

Various forms of combined cooking and heating stoves have been heretofore provided. However, few such structures are constructed in a manner whereby they may be transformed from a cooking unit provided with a cooking utensil surface in direct communication with the fire therein into an air heating unit whereby substantially all of the heat developed by the unit may be conveyed to an adjacent or remote location to be heated. Accordingly, previously known combined heating and cooking units are less efficient for heating and for cooking operations than they might be. In addition, many combined heating and cooking units are not designed whereby they may be readily transported and, when utilized as a heating unit, operative to supply heat to a remote area to be heated.

Accordingly, a need exists for a combined heating and cooking unit of improved efficiency for both the heating and cooking operations and which may also be utilized, when functioning as heater, to heat a remote location.

Examples of previously known combined heating and cooking structures as well as various heating and cooking structures including some of the general structural and operation features of the instant invention are disclosed in U.S. Pat. Nos. 3,636, 656,460, 1,334,827, 2,159,156, 2,220,637 and 2,742,892.

BRIEF DESCRIPTION OF THE INVENTION

The combined heating and cooking unit of the instant invention is constructed whereby heating or cooking operations may be efficiently conducted. Further, the unit is also constructed in a manner whereby it is readily portable. Still further, the unit is constructed in a manner whereby it may supply heated air to a remote location.

The combined heating and cooking unit is designed to utilize various forms of solid fuels although it could be readily modified to burn gaseous and liquid fuels if portability thereof was not desired. Further, the heating and cooking unit is constructed in a manner whereby it is operable to heat a remote location without benefit of air pump structure for pumping air to be heated therethrough.

SUMMARY OF THE INVENTION

The main object of this invention is to provide a combined heating and cooking unit which may be readily transported from one location to another.

Another object of this invention is to provide a combined heating and cooking unit which will be highly efficient in both the heating and cooking modes thereof.

A still further object of this invention is to provide a combined heating and cooking unit which may be utilized to heat remote locations.

Another important object of this invention is to provide a combined heating and cooking unit which may be readily modified to burn various forms of fuels.

A final object of this invention to be specifically enumerated herein is to provide a combined heating and cooking unit which will conform to conventional forms of manufacture, be of simple construction and easy to use so as to provide a device that will be economically feasible, longlasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 6 is a fragmentary perspective view of the upper portion of the unit in readiness to be utilized as a cooking stove and with removable extension and warming tables therefor illustrated in exploded positions;

FIG. 7 is a fragmentary enlarged vertical sectional view taken substantially upon the plane indicated by the section line 7—7 of FIG. 6;

FIG. 8 is a perspective view of the fire box of the unit with an accessory grill supported over the top portion of the fire box; and FIG. 9 is a perspective view of an openable metal housing to be utilized for containing the accessory shelves, a pair of flue pipe sections and length of insulated flexible duct when transporting the combined heating and cooking unit and which housing may also be utilized as a oven in connection with the unit when the shelves, flue pipe sections and duct are removed therefrom.

DETAILED DESCRIPTION OF THE INVENTION

Figure 1:
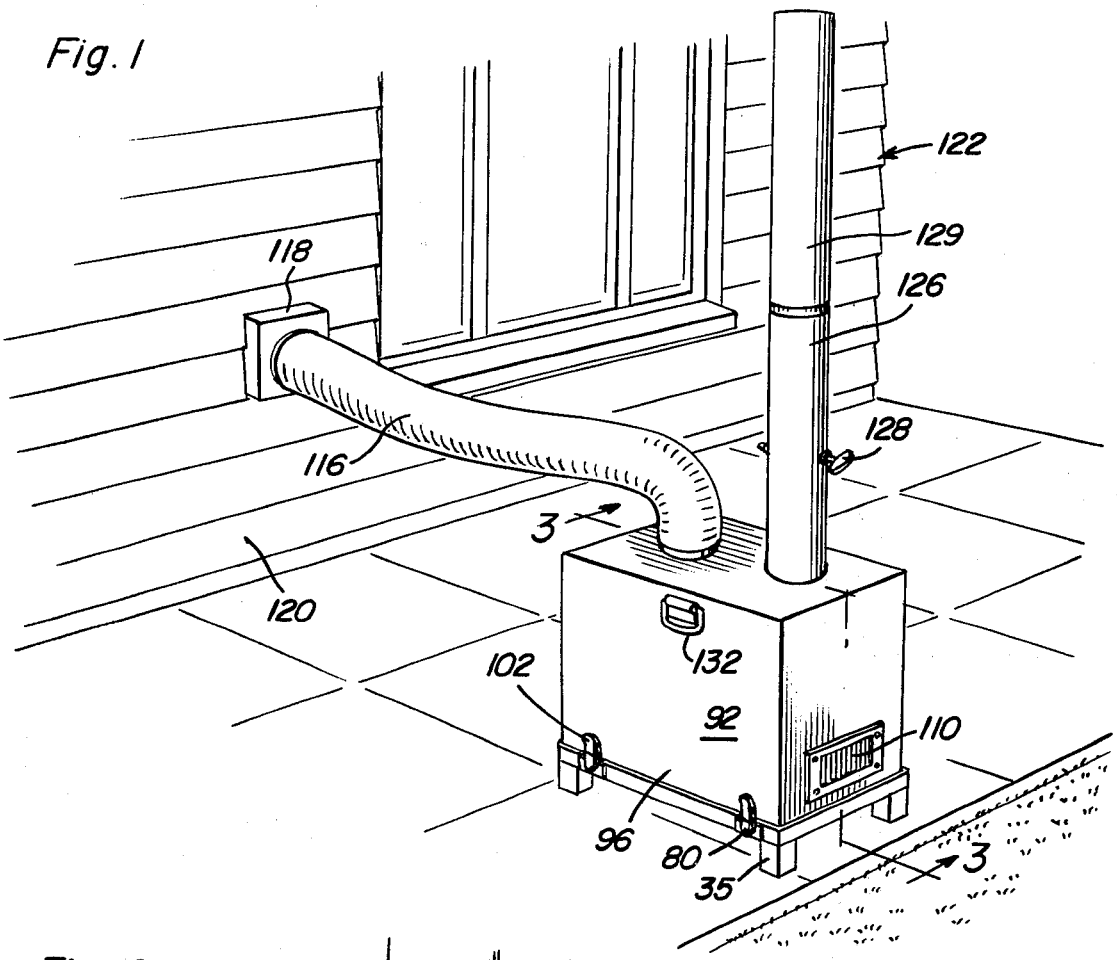
FIG. 1 is a perspective view of the combined heating and cooking unit of the instant invention in use as a heater for heating a remote location.
Figure 2:
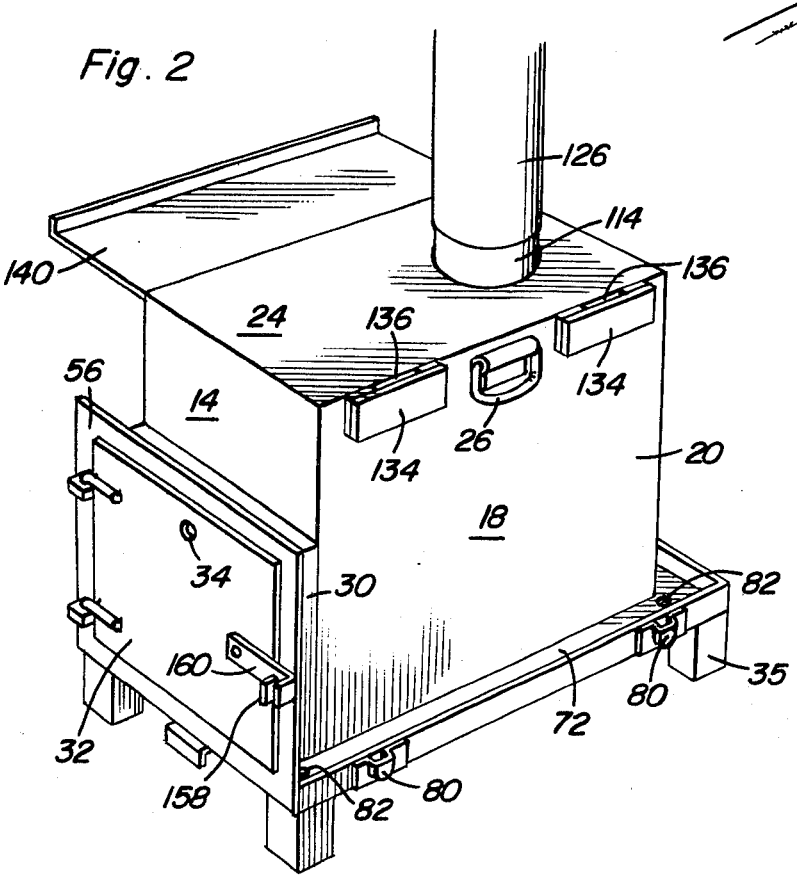
FIG. 2 is a perspective view of the unit as seen from the reverse side of FIG. 1 and in readiness to be used as a cooking unit.

Referring now more specifically to the drawings the numeral 10 generally designates the combined cooking and heating unit of the instant invention. The unit 10 includes a fire box referred to in general by the reference numeral 12 having front and rear walls 14 and 16, opposite side walls 18 and 20, a bottom wall 22 and a top wall 24. The bottom and top walls 22 and 24 extend between the walls 14, 16, 18 and 20 in order to define a substantially closed fire box. The opposite side walls 18 and 20 include pivoted bail-type handles 26 and 28 and the lower portion of the front wall 14 includes a horizontally outwardly projecting hollow neck 30 provided with a hinged closure door 32 at its outer end having a small peep opening 34 formed therethrough.

The bottom wall includes depending corner legs 35 and a plurality of central longitudinally spaced air inlet openings 36 are formed through the bottom wall and longitudinally spaced transverse support braces 38 are supported therefrom beneath the latter in spaced in relation relative thereto from longitudinal members 40 secured to the undersurface of the bottom wall 22 on opposite sides of the openings 36. A slide plate 42 having a plurality of longitudinally spaced openings 44 formed therethrough is slidingly supported from the braces 38 between the longitudinal members 40 and includes a pair of downturned flanges 46 and 48 on its front and rear ends. The flanges 46 and 48 are engageable with the remote sides of the remote braces 38 in order to limit longitudinal shifting of the plate 42 between a first position with the openings 36 and 44 in full registry with each other and a second position with the openings 36 and 44 completely out of registry with each other, the openings 36 and 44 defining draft air inlet openings for the fire box 12.

An upwardly opening receptacle referred to in general by the reference numeral 50 is removably supported within the fire box 12 from longitudinal members 52 supported from and extending along upper surface opposite side portions of the bottom wall 22. The receptacle 50 defines a fire pan and includes randomly apertured longitudinal opposite side walls 54 and opposite end walls 56 and 58 interconnected by means of a bottom wall 60. The end wall 56 is also randomly apertured and both end walls 56 and 58 include outwardly projecting and downwardly directed handles 62. Further, it will be noted that the receptacle or fire pan 50 is of a size to be withdrawn and inserted through the neck 30 when the door 32 is in its open position. Also, from FIGS. 3 and 4 of the drawings, it may be seen that the upper portion of the interior of the fire box 12 includes a pair of transverse angle members 64 extending between the opposite side walls 18 and 20 and from which a baffle plate 66 is supported with the opposite ends of baffle plate 66 spaced inwardly from the inner surfaces of the end walls 14 and 16.

The top wall 24 of the fire box includes an opening formed therethrough in which the lower end of a flue pipe section 68 is secured. It may be seen from FIG. 3 of the drawings that the upper end of the flue pipe section 68 projects above the top wall 93.

Figure 4:
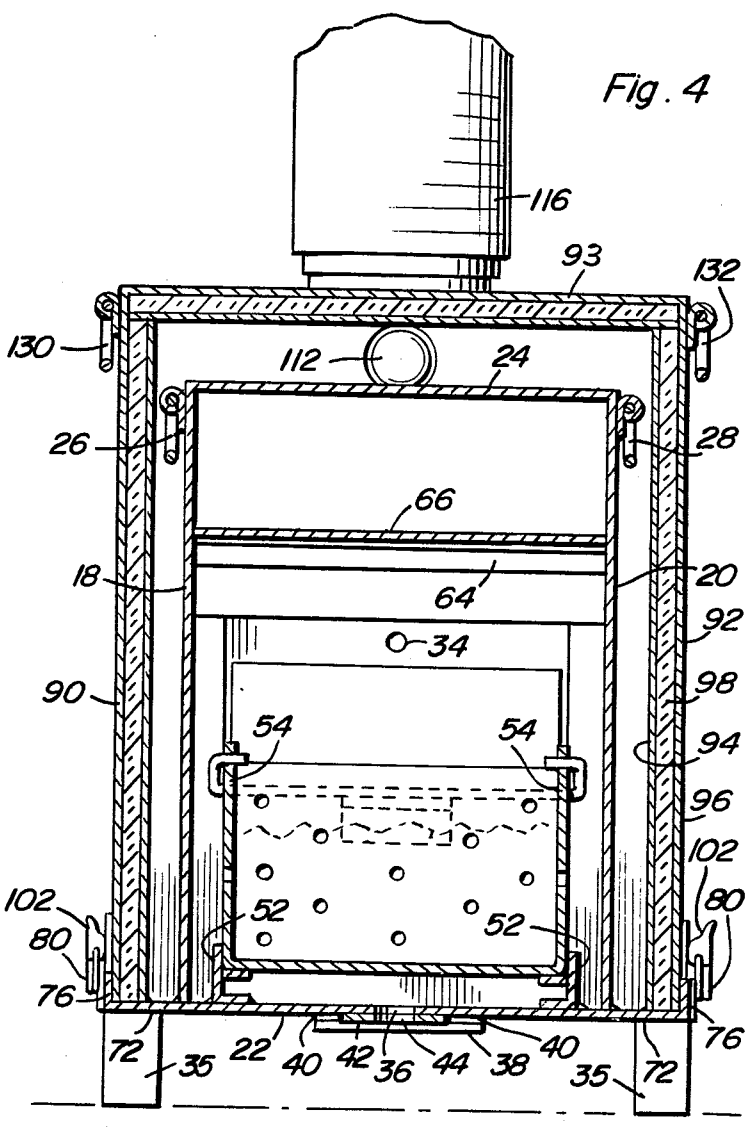
FIG. 4 is a vertical sectional view taken substantially upon the plane indicated by the section line 4—4 of FIG. 3.
Figure 3:
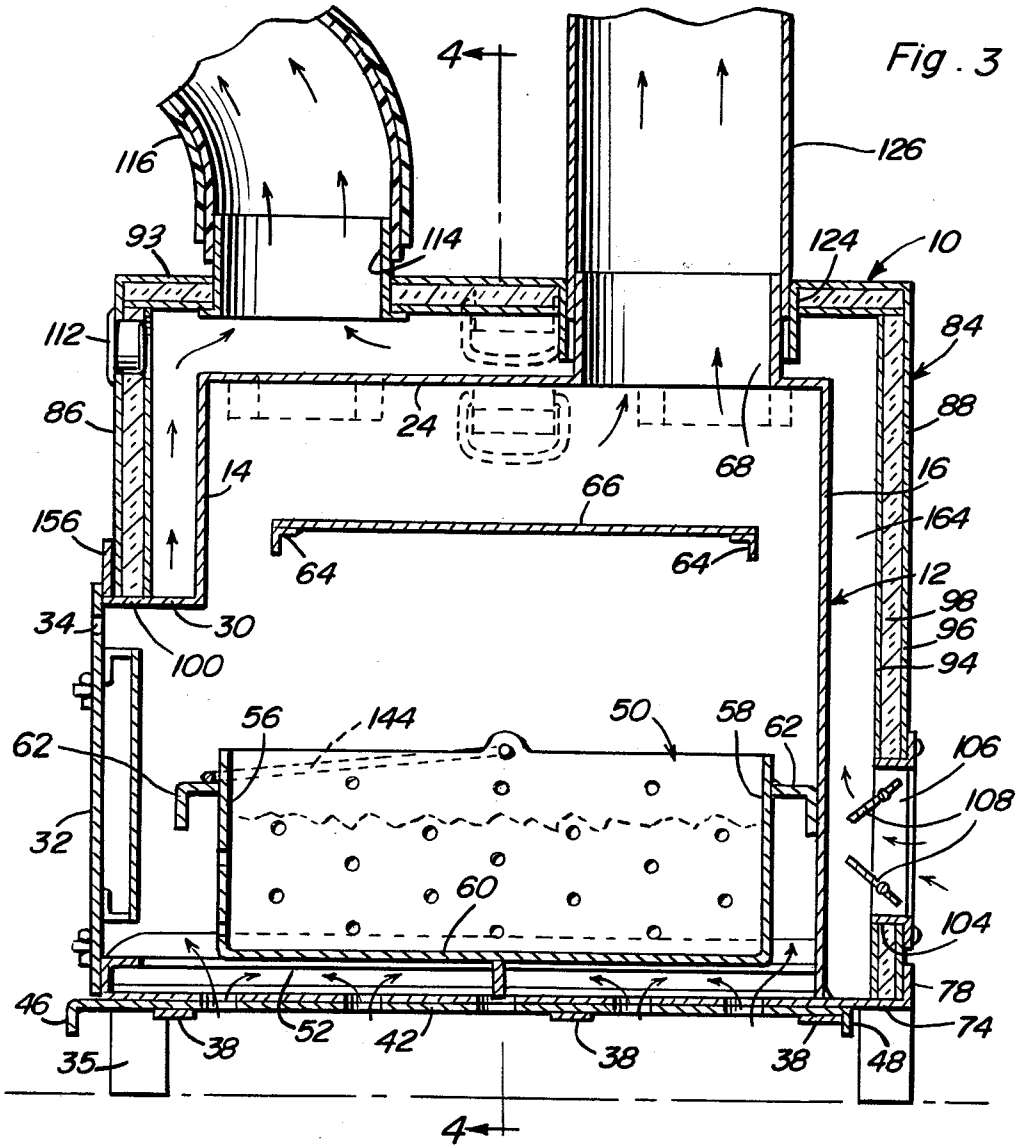
FIG. 3 is an enlarged vertical sectional view taken substantially upon the plane indicated by the section line 3—3 of FIG. 1.

From FIGS. 3 and 4 of the drawings it may be seen that the opposite side and rear marginal portions of the bottom wall 22 include outwardly projecting seating flanges 72 and 74 and that the outer extremities of the flanges 72 and 74 terminate outwardly in upturned flanges 76 and 78 with the flanges 76 including latch components 80 supported therefrom at points spaced along each of the flanges 76. Further, the opposite end portions of each of the seating flanges 72 include drain openings 82 formed therethrough.

The unit 10 further includes a plenum box referred to in general by the reference numeral 84 having front and rear walls 86 and 88, opposite side walls 90 and 92 and a top wall 93. Each of the walls 86, 88, 90 and 92 includes an inner metallic layer 94, an outer metallic layer 96 and an intermediate insulative layer 98 sandwiched between the inner and outer layers 94 and 96.

The front wall 86 of the plenum box includes a downwardly opening notch 100 formed therein in which the neck 30 is snugly received when the plenum box 84 is telescoped downwardly over the fire box 12 with the lower marginal edges of the opposite side and rear walls of the plenum box 84 seated against the seating flanges 72 and 74 and received inwardly of the flanges 76 and 78. The lower marginal portions of the opposite side walls 90 and 92 include latch components 102 supported therefrom and spaced therealong cooperable with the latch components 80 to releasably secure the plenum box 84 against upward displacement relative to the fire box 12.

The rear wall 88 of the plenum box 84 includes an opening 104 formed therethrough in which a tubular register frame 106 is secured including a pair of pivotal openable and closable damper plates 108. The outer side of the register frame 106 includes louvers 110, see FIG. 1.

In addition, the front wall 86 of the plenum box 84 includes a thermometer assembly 112 communicated with the interior of the plenum box 84 and the top wall 93 of the plenum box 84 includes a heated air outlet neck 114 opening outwardly therethrough to which the inlet end of a flexible insulated heated air duct 116 is connected. The outlet end of the heated air duct 116 opens through a tubular fitting 118 secured through a wall 120 of a building structure referred to in general by the reference numeral 122 whose interior is to be heated by heated air supplied thereto from the unit 10.

The top wall 93 of the plenum box 84 includes a flue outlet opening having a sleeve 124 secured therethrough and projecting downwardly below the top wall 93. The lower end of a first flue pipe section 126 provided with a pivoted damper control 128, see FIG. 1, is telescoped downwardly over the upper end of the flue pipe section 68 and into the upper end of the sleeve 124. The upper end of the flue pipe section 126 telescopes into the lower end of a second flue pipe section 129.

The upper marginal portions of the opposite side walls 90 and 92 of the plenum box 84 include pivoted bail-type handles 130 and 132 corresponding to the handles 26 and 28 and the upper marginal portions of the side walls 18 and 20 include brackets 134 defining upwardly opening sockets 136 in which downwardly directed support flanges 138 of a pair of opposite side support tables or shelves 140 are receivable for supporting the support tables from opposite side portions of the fire box 12 in substantially co-planar relation with the top wall 24.

Further, a grill 142 is provided for removable disposition over the open top of the fire pan 50 and the latter is also provided with a pivoted bail handle 144. Also, an upwardly opening hollow housing 146 is provided and includes a hinged top 148 provided with a thermometer 150 and a variably openable vent opening 152. The opposite ends of the housing 146 include pivoted bale handles 154 and the housing 146 is positionable on the top wall 24 and may be utilized as an oven. In addition, the flue pipe sections 126 and 128, shelves 140 and the flexible duct 116 are all receivable within the housing 146 when the latter is not to be used as an oven and the unit 10 is to be readied for transport or storage.

The outer end of the neck 30 includes an outwardly projecting peripheral flange 156 from which a notched upstanding latch member 158 is supported and the door 32 includes a pivoted latch member 160 engageable behind the latch member 158 in order to retain the door 32 in a closed position.

When it is desired to utilize the unit 10 as a cooking unit, the outer plenum housing 84 may be upwardly removed from the position thereof illustrated in FIGS. 1, 3 and 4 of the drawings and a fire may be made within the fire pan 50. The shelves 140 may be removably supported from the brackets 134 and the upper surface of the top wall 24 of the fire box 12 may be utilized as a cooking surface and the shelves 140 may be utilized as supporting surfaces and warming surfaces. The slide plate 42 may be adjusted to provide the desired draft air for supported the fire within the fire pan 50.

On the other hand, if the unit 10 is to be utilized for heating purposes and to supply heated air to the interior of the building 122, the flue pipe sections 126 and 128 are first removed and the plenum housing 84 is downwardly telescoped over the fire box 12 and supported from the support flanges 72 and 74 in the manner illustrated in FIGS. 3 and 4 of the drawings after the shelves 140 have been also removed. Thereafter, the flue pipe sections 126 and 128 may be again installed and the flexible duct 116 may be operatively connected between the outlet neck 114 and the fitting 118. Thereafter, the plates 108 may be adjusted to provide the desired ingress of air to be heated within the chamber 164 defined between the spaced opposite side walls 18 and 20 and the side walls 90 and 92, between the rear walls 16 and 98 and between the top walls 24 and 94. The air entering the chamber 164 is thus heated and tends to rise within the chamber 164 by convection and exists through the outlet neck 114 into the duct 116 and thereafter moves through the duct 116 into the interior of the building 122 through the fitting 118 secured through the side wall 120. Of course, it may be seen that flue gases are maintained completely out of communication with the chamber 164.

Figure 5:
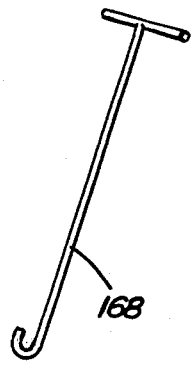
FIG. 5 is a perspective view of a pull handle to be utilized in removing and shifting the position of the fire box within the combined stove and heating unit.

When the unit 10 is being utilized as a heating unit, the latch structures or components 80 and 102 are operatively engaged with each other to prevent upward displacement of the plenum box 84 relative to the fire box 12. Inasmuch as the handles 130 and 132 are supported from the outer sides of the side walls 90 and 92 and the latter are insulated, the unit 10 may be readily transported by hand even when a fire is disposed within the fire box 50. Further, the handles 26 and 28 may be utilized to transport the unit 10 when the plenum box 84 is removed therefrom. Also, a pull handle 168 is shown in FIG. 5 and may be used to shift the plate 42, remove and replace the fire pan 50 and shift the door 32 between the open and closed position thereof.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A portable heating and cooking stove, said stove including a fire box having upstanding peripheral walls and bottom and top wall means, said fire box including lower draft air inlet means and upper flue gas outlet means, the lower portion of said fire box including horizontally outwardly projecting seat means extending peripherally about at least all but one peripheral wall portion of said fire box, a downwardly opening hollow plenum box including upstanding peripheral walls and top wall means, said plenum box being removably downwardly telescoped over said fire box with lower portions of peripheral wall means thereof seated against said seat means, and the corresponding peripheral walls and wall means and top walls of said fire box and plenum box in spaced relation defining a heating chamber therebetween, said flue gas outlet means opening upwardly through said top wall means of said fire box and including an outlet pipe portion, said top wall means of said plenum box including an opening therethrough into which said outlet pipe portion projects, said one peripheral wall portion including a horizontally outwardly projecting hollow neck opening through the lower portion thereof defining a fuel inlet passage, the peripheral wall portion of said plenum box parallel and adjacent said one peripheral wall portion including a downwardly opening notch formed in the lower portion thereof in which said neck is snugly received, intake means for admitting air to be heated into a lower portion of said heating chamber and heated air discharge means for discharging heated air from an upper portion of said heating chamber.

2. The combination of claim 1 wherein said plenum box top wall means includes a second opening formed therethrough comprising said heated air discharge means.

3. The combination of claim 1 wherein said intake means comprises an opening formed through a lower portion of one of said peripheral walls of said plenum box.

4. The combination of claim 1 wherein the outer end portion of said hollow neck includes a closure door therefor shiftable relative thereto between open and closed positions.

5. The combination of claim 1 wherein said fire box and plenum box include coacting means releasably securing said boxes together against upward displacement of said plenum box relative to said fire box.

6. The combination of claim 1 wherein said draft air inlet means opens upwardly into said fire box through the bottom wall means thereof and is equipped with adjustable damper means for controlling the flow of draft air therethrough into said fire box.

7. The combination of claim 6 wherein said fire box is designed to burn solid fuel and includes a fire pan supported in elevated position relative to said bottom wall means and removable through said hollow neck.

8. The combination of claim 7 wherein said fire pan includes a centrally mounted bail handle pivotally supported therefrom and extending thereacross from one side of said fire pan to the remote side thereof.

9. The combination of claim 8 including a grate for said fire pan removably mountable over the open top of said fire pan for direct grilling of food on said grate.

10. The combination of claim 1 including flexible insulated duct means including a first inlet end for releasable connection with said heated air discharge means and a second discharge end for discharging heated air in a location remote from said fire box.

11. The combination of claim 1 wherein said peripheral wall and top wall means of said plenum box are insulated and include metal inner panels for reflecting radiant heat from said fire boxes back into said chamber.

12. In combination with a fire box and a plenum box enclosing at least a major portion of said fire box therewith in a manner defining a heating air chamber between opposing wall portions of said fire and plenum box, air inlet and outlet means for the entrance of ambient air into said chamber to be heated and the discharge of heated air from said chamber, said fire box including a flue gas outlet pipe opening outwardly of said fire box and bridging the adjacent portion of said chamber, the wall portion of said plenum box opposing said outlet pipe having an access opening therein, said access opening having a sleeve received therein projecting inwardly of said plenum box wall portion and loosely telescoped over said outlet pipe, thereby defining an annular space between the inner and outer surfaces of said sleeve and outlet pipe, and a flue pipe section including an inlet and telescoped into said annular space to form a flue gas conduit for flue gas from the interior of said fire box through said chamber and outwardly of the exterior of said fire box without contamination of the air passing through said chamber by flue gases passing through said conduit.

* * * * *